US007299518B1

(12) United States Patent
Paulson

(10) Patent No.: US 7,299,518 B1
(45) Date of Patent: Nov. 27, 2007

(54) VACUUM CLEANER WITH MAGNETIC FLUX FIELD

(76) Inventor: Jerome I. Paulson, 26 Creekside Dr., Millersville, PA (US) 17551

( * ) Notice: Subject to any disclaimer, the term of this patent is extended or adjusted under 35 U.S.C. 154(b) by 549 days.

(21) Appl. No.: 10/639,129

(22) Filed: Nov. 20, 2003

(51) Int. Cl.
*A47L 13/46* (2006.01)

(52) U.S. Cl. ..... 15/1.51; 134/1; 134/21

(58) Field of Classification Search ..... 15/327.1, 15/327.2, 327.3, 327.4, 327.5, 327.6, 327.7, 15/319, 339, 350–353, 363, 364, 383; 134/1, 134/6, 21, 26, 42
See application file for complete search history.

(56) References Cited

U.S. PATENT DOCUMENTS

| | | | | |
|---|---|---|---|---|
| 1,677,625 A | * | 7/1928 | Frantz | 15/377 |
| 2,202,989 A | * | 6/1940 | Kitto | 15/382 |
| 2,260,325 A | * | 10/1941 | Leathers | 15/382 |
| 2,280,751 A | | 4/1942 | Davis | 15/158 |
| 2,288,115 A | * | 6/1942 | Soldanels | 15/339 |
| 2,590,152 A | | 3/1952 | Buckey | 15/319 |
| 3,355,755 A | | 12/1967 | Brooks | 15/1.5 |
| 4,197,610 A | | 4/1980 | Schneider | 15/383 |
| 4,715,086 A | | 12/1987 | Johanson | 15/339 |
| 4,728,942 A | | 3/1988 | England | 340/679 |
| 4,866,565 A | | 9/1989 | Wray | 361/215 |
| 5,027,469 A | | 7/1991 | Toyoshima | 15/339 |
| 5,920,954 A | | 7/1999 | Sepponen | 15/339 |
| 6,199,244 B1 | | 3/2001 | Hilgers | 15/339 |

FOREIGN PATENT DOCUMENTS

JP 04009128 A * 1/1992

OTHER PUBLICATIONS

English Translation of JP 4-9128 to Takemoto et al.*
Copy of diode definition from www.definethat.com.*

* cited by examiner

*Primary Examiner*—David Redding
(74) *Attorney, Agent, or Firm*—Miller Law Group, PLLC

(57) ABSTRACT

A cleaning head for a vacuum sweeper that incorporates a magnetic flux generator that bathes the area of carpet being engaged by the rotating brush beater in the cleaning head with a pulsing magnetic field. The magnetic flux generator disrupts the static attraction between opposing charged small particles and the carpet fibers to which the small particles are attached to allow the brush beater apparatus in the cleaning head to separate the small particles from the carpet fibers. The dislodged small particles, including allergens, bacteria and mold spores, are removed from the carpet in the air stream created by the vacuum sweeper and captured by a micro-filter filtration system. The magnetic flux field is created with the conventional household current that powers the operation of the vacuum cleaner without requiring the generation of high voltages or an electrostatic discharge from the cleaning head.

19 Claims, 4 Drawing Sheets

VACUUM CLEANER WITH MAGNETIC FLUX FIELD

BACKGROUND OF THE INVENTION

The present invention relates generally to vacuum cleaners for use in cleaning carpets and other flooring materials in buildings and, more particularly, to a vacuum sweeper that incorporates a magnetic flux field to disrupt the static attraction of dust particles to carpet fibers.

Vacuum sweepers have been in use for many decades for the cleaning of carpets and other flooring materials in houses, businesses and other buildings. A conventional vacuum sweeper utilizes a fan to create a air flow through the structure of the sweeper and create a slight vacuum at the cleaning head to urge dust and other debris upwardly through the cleaning head into a collection system, typically a bag or other container surrounding a filter to dislodge the dust, dirt and other debris from the flow of air through the vacuum cleaner structure. Typically, the cleaner head incorporates a rotating brush beater that agitates the carpet fibers to try to separate the dust and dirt from the carpet fibers and allow the material to enter the air flow.

Present vacuum cleaners have been incorporating modern filtration systems, including hepa filters and micro-filters to capture smaller particles, such as allergens, bacteria and mold spores that may be found in the air flow through the structure of the vacuum cleaner. However, present cleaning heads are not very capable of removing such small particles from carpet fibers due to a static attraction between opposite electrical charges on the particle and the carpet fiber. In an effort to effect a separation of these small statically charged particles from the carpet fibers, modern cleaning heads have increased suction and more aggressive beater assemblies.

The separation of these small statically charged particles has been the focus of some patent activity in which an ion generator is placed on the cleaning head of a vacuum sweeper to either neutralize or eliminate the static attraction between the small particles and the carpet fiber to which the particle is engaged. Elimination of the static charges on the particles is the intent of the introduction of electrostatic charges from the cleaning head. In U.S. Pat. No. 2,280,751, issued to H. L. Davis on Apr. 21, 1942, the vacuum cleaner nozzle is provided with a smooth hard di-electric material that will generate an electrostatic charge when rubbed across the surface of the carpet. In U.S. Pat. No. 3,355,755, issued to J. R. Brooks on Dec. 5, 1967, a piezo-electric electrostatic brush having a conductor proximate to the dust cavity within the arrangement of bristles. In U.S. Pat. No. 4,197,610, issued to H. W. Schneider on Apr. 15, 1980, the housing surrounding the brush beater is grounded electrically to attract dirt particles that might be clinging to the brushes. In U.S. Pat. No. 4,715,086, issued to R. H. Johanson on Dec. 29, 1987, and in U.S. Pat. No. 4,866,565, issued to C. C. Wray on Sep. 12, 1989, electrostatic charges that may have accumulated on the wand during operation of the cleaning head can be dissipated.

Other attempts to neutralize the static attraction between the small particles and the carpet fibers involve ion generators, which require substantial voltages and potential danger. In U.S. Pat. No. 5,920,954. issued to R. Sepponen on Jul. 13, 1999, the vacuum cleaner is provided with an ionization electrode coupled to a generator of up to 10,000 volts of electricity. Although the current is low, the voltage is extremely high in order to generate the ion flow. The power required to generate such an ion flow is impractical for household vacuum sweepers and potentially dangerous to the operator. In U.S. Pat. No. 6,199,244, issued to S. Hilgers on Mar. 13, 2001, a generator is provided on the cleaning head to generate up to 20,000 volts of electricity in order to place an electrostatic charge on the base plate of the cleaning head.

In U.S. Pat. No. 4,728,942, issued to J. F. 1. England on Mar. 1, 1988, a magnet is used in the core of the brush beater to generate an electrical current when the brush beater is rotating that powers a light-emitting diode to indicate that the brush beater is actually rotating. The England patent does not teach the induction of a magnetic flux to disrupt the static charges on small particles in the carpet being cleaned. In U.S. Pat. No. 5,027,469, issued to H. Toyoshima, et al on Jul. 2, 1991, magnets are placed at various places in a vacuum sweeper to attract ferrous dust particles to prevent attraction thereof to the rotor and stator of the sweeper motor, thus increasing the life of the motor. The Toyoshima patent does not contain any teachings for the creation of a magnetic flux field that will disrupt the static attraction between small particles and carpet fibers. In a related teaching in U.S. Pat. No. 2,590,152, issued to J. P. Buckley on Mar. 25, 1952, a sterilizing ultraviolet generator is mounted in the cleaning head of a vacuum sweeper to destroy germs and bacteria in the carpet during operation thereof over the surface of the flooring.

The use of a magnetic flux field to disrupt the static attraction of small dust particles to plastic particles and the like is taught in U.S. Pat. No. 5,035,331, issued to Jerome I. Paulson on Jul. 30, 1991, in the form of a dedusting apparatus for plastic particles. In this Paulson patent, the plastic pellets are fed through a housing where air is blown through the pellets to remove the dust particles from the pellets. The small dust particles, however, will continue to cling to the pellets due to opposite static charges and the resulting attraction therebetween. This static attraction is disrupted by the magnetic flux field to enable the air current to remove the small dust particles from the pellets. Such technology is highly effective in removing dust particles as small as 0.001 microns, which is the general size of pollen and bacteria.

Accordingly, it would be desirable to provide a vacuum sweeper cleaning head with a magnetic flux generator to be effective in disrupting the static attraction between small particles clinging to carpet fibers as the cleaning head is passed over the carpet to effect a cleaning thereof. The increased effectiveness is dislodging small particles from carpet will result in an effective utilization of current filtration technology and the removal of bacterial and allergens from the carpet.

SUMMARY OF THE INVENTION

It is an object of this invention to overcome the aforementioned disadvantages of the known prior art by providing a magnetic flux generator on the cleaning head of a vacuum sweeper.

It is another object of this invention to provide a vacuum cleaner that is more efficient in cleaning small particles from carpet.

It is a feature of this invention that the static attraction between small particles and the carpet fibers to which the small particles are attached is disrupted.

It is an advantage of this invention that very small particles, including allergens and bacteria, can be removed from carpet flooring by a vacuum cleaner.

It is still another object of this invention to provide a vacuum sweeper that will clean carpet materials effectively to permit a corresponding effective use of filtration systems to capture small particles within the air stream from the cleaning head.

It is yet another object of this invention to provide a cleaning head for a vacuum sweeper that incorporated a magnetic flux generator to disrupt the static attraction between small particles and carpet fibers.

It is another advantage of this invention that improved cleaning of carpets can be achieved by use of a vacuum cleaner.

It is another feature of this invention that the conventional cleaning head for a vacuum sweeper incorporating a beater brush can still be utilized in conjunction with a magnetic flux generator.

It is still another advantage of this invention that the addition of a magnetic flux generator does not require a drastic change to the structure of a vacuum sweeper cleaning head.

It is yet another advantage of this invention that separation of small particles from carpet fibers can be achieved without requiring the generation of high voltages from an electrostatic ion generator.

It is yet another feature of this invention that the magnetic flux generator can be attached to the top surface of a vacuum sweeper cleaning head.

It is a further advantage of this invention that the disruption of the static attraction between oppositely charged small particles and carpet fibers can be accomplished safely without the creation of electrostatic charges.

It is still another feature of this invention that the magnetic flux generator bathes the carpet field being engaged by the cleaning head of a vacuum sweeper with a toroidal magnetic field having a pulsed intensity to disrupt static attraction between small particles and carpet fibers.

It is still a further advantage of this invention that the magnetic flux generator can be operated with conventional household alternating current or a direct current source of electricity.

It is still another advantage of this invention that several sweeps with a vacuum sweeper cleaning head incorporating the principles of the instant invention could substantially completely eliminate the allergens, bacteria and mold spores from carpet.

It is yet another object of this invention to provide a vacuum sweeper incorporating a magnetic flux generator to increase the operating efficiency of the cleaning head that is durable in construction, inexpensive of manufacture, carefree of maintenance, facile in assemblage, and simple and effective in use.

These and other objects, features and advantages are accomplished according to the instant invention by providing a cleaning head for a vacuum sweeper that incorporates a magnetic flux generator that bathes the area of carpet being engaged by the rotating brush beater in the cleaning head with a pulsing magnetic field. The magnetic flux generator disrupts the static attraction between opposing charged small particles and the carpet fibers to which the small particles are attached to allow the brush beater apparatus in the cleaning head to separate the small particles from the carpet fibers. The dislodged small particles, including allergens, bacteria and mold spores, are removed from the carpet in the air stream created by the vacuum sweeper and captured by a micro-filter filtration system. The magnetic flux field is created with the conventional household current that powers the operation of the vacuum cleaner without requiring the generation of high voltages or an electrostatic discharge from the cleaning head.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
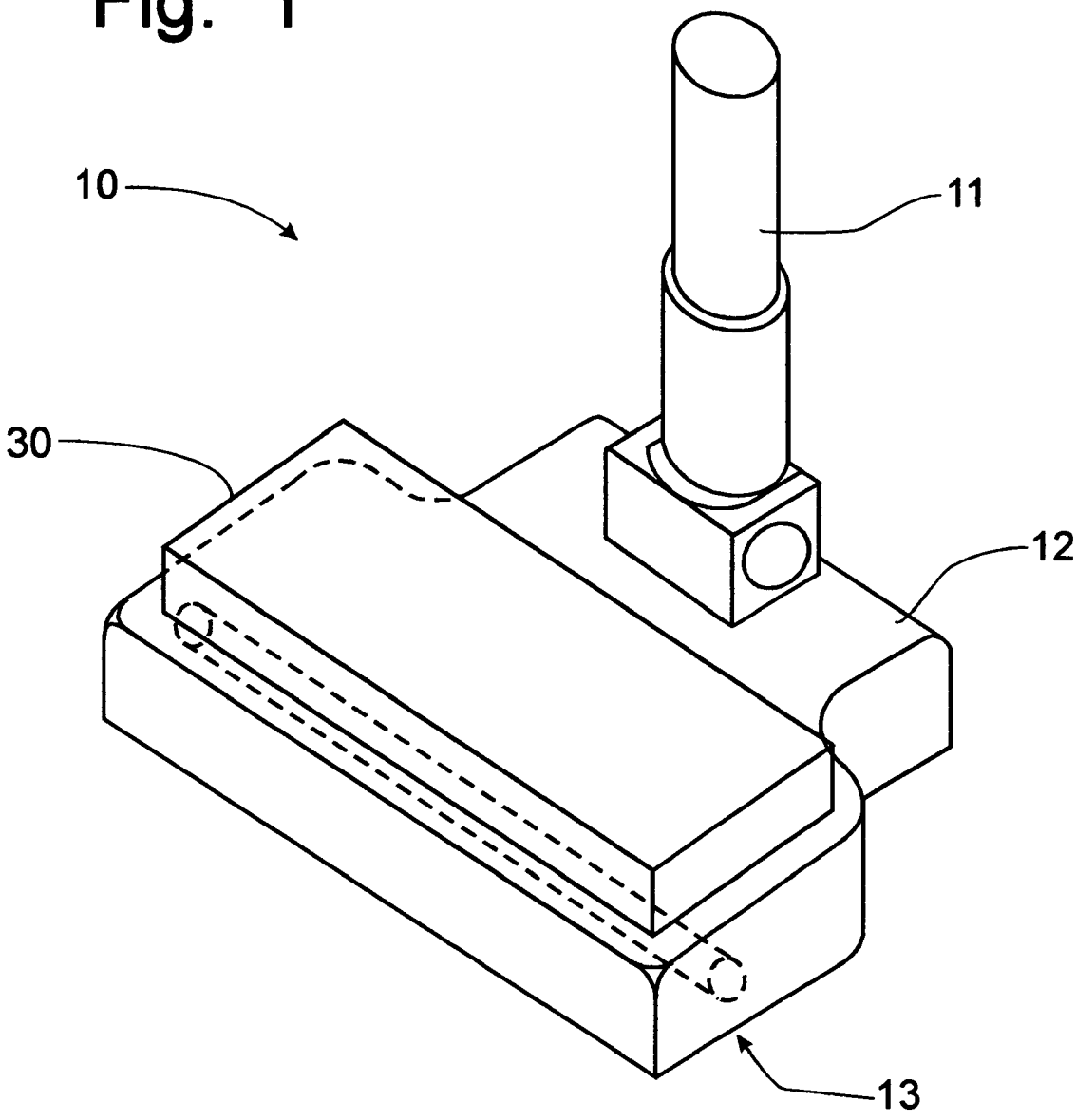
FIG. 1 is a schematic perspective view of a vacuum sweeper cleaning head incorporating the principles of the instant invention.
Figure 2:
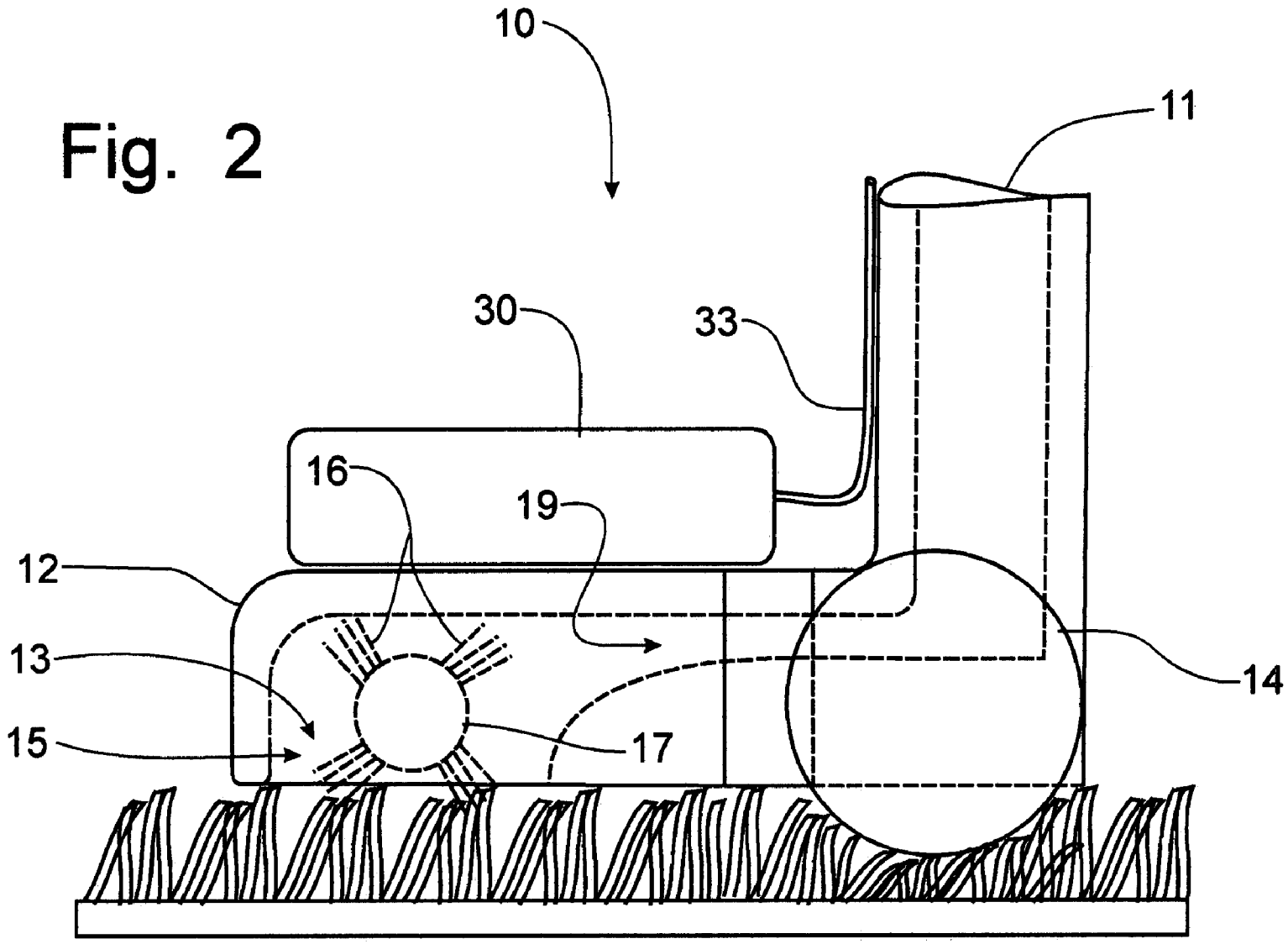
FIG. 2 is a schematic left side elevational view of a cleaning head for a vacuum sweeper incorporating the principles of the instant invention.
Figure 3:
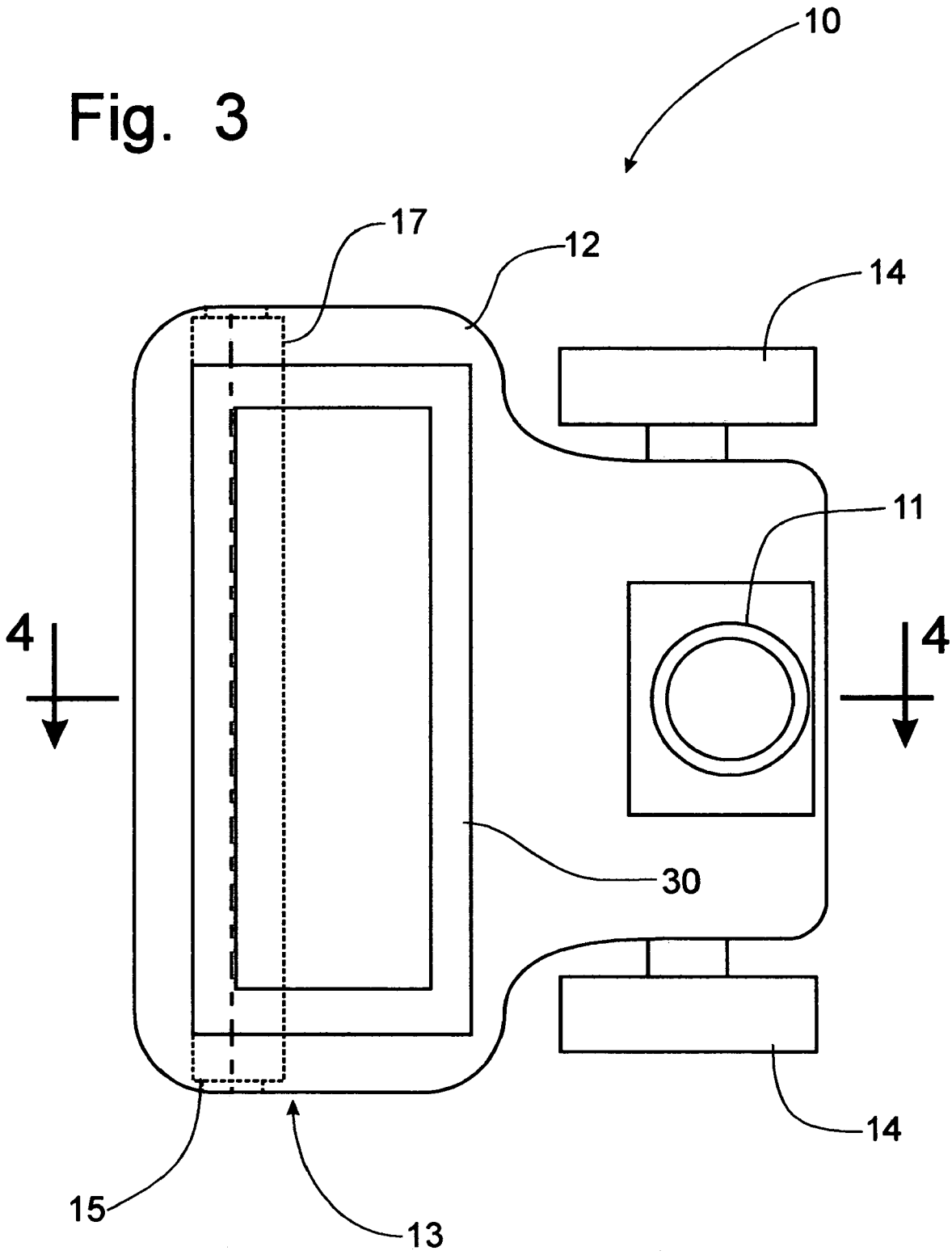
FIG. 3 is a top plan view of the cleaning head depicted in FIG. 2

Referring now to FIGS. 1-4, a cleaning head forming part of a vacuum sweeper incorporating the principles of the instant invention can best be seen. The cleaning head 10 is a part of a vacuum sweeper or cleaner that is moved across the surface of the floor over carpet material to release and collect dust, dirt and other materials from the carpet 20. As one of ordinary skill in the art will recognize, the vacuum cleaner is provided with a fan mechanism (not shown) that creates a flow of air through the cleaning head 10 to suction dust, dirt and other materials from the carpet 20 upwardly through the cleaning head 10 to be engaged with a filtration system (not shown). The conventional filtration system for vacuum cleaners will preferably include a micro-filter that is operable to extract particles from the dirt laden air stream coming from the cleaning head 10 before the air is discharged to the atmosphere so that the captured dust, dirt and other materials do not become discharged back into the atmosphere.

The conventional vacuum sweeper, as will be readily understood by one of ordinary skill in the art, is powered from conventional household current at 110-120 volts to operate the fan creating the aforementioned air flow from the cleaning head 10 into the filtration system. The cleaning head 10 can be attached to a wand 11 that serves as a conduit to convey the air stream coming from the cleaning head 10 to the filtration system, which is typically contained in the canister housing (not shown). One skilled in the art will recognize that a canister-type of vacuum sweeper is merely one of several possible conventional configurations for a vacuum sweeper. Another configuration is an upright model in which the cleaning head 10 is attached to the lower portion of the housing of the vacuum cleaner for engagement with the floor. The wand 11 typically becomes an internal conduit in the upright model of vacuum sweeper, but still functions to convey the air stream coming from the cleaning head 10 to the filtration system for cleansing and filtering of the air stream. One of ordinary skill in the art will recognize that the principles of the instant invention are not limited to the particular configuration of vacuum sweeper.

The cleaning head 10 is typically formed with a housing 12 forming the outer shell of the cleaning head 10. A pair of wheels 14 can be attached to opposing sides of the cleaning head 10 to facilitate the movement of the cleaning head 10 over the surface of the floor. The provision of wheels 14, however, is not required for operation of the present invention and is dependent on the configuration of vacuum sweeper on which the instant invention is deployed. The housing 12 typically has a transverse width defining the cleaning zone 13 at a forward portion of the housing 12 at which the vacuum associated with the air flow created by the operation of the powered rotatable fan (not shown).

The housing 12 typically supports a beater brush 15 at the forward portion of the housing 12 for rotation at the cleaning zone 13. The rotatable beater brush 15 preferably has a spirally wound brush element 16 extending circumferentially around a tubular housing 17 projecting from side to side in the housing 12. The function of the beater brush 15 is to agitate the carpet fibers 25 in the cleaning zone 13 as the cleaning head 10 is moved over the surface of the carpet 20. The beater brush 15 mechanically dislodges some of the dust and dirt in the carpet 20, particularly those particles having a significant size which have a weak static attraction to the carpet fibers 25. The dislodged dirt particles from the carpet 20 are then sucked into the passageway 19 through the cleaning head 10 to the wand 11 for conveyance to the filtration system.

Figures 4, 5:
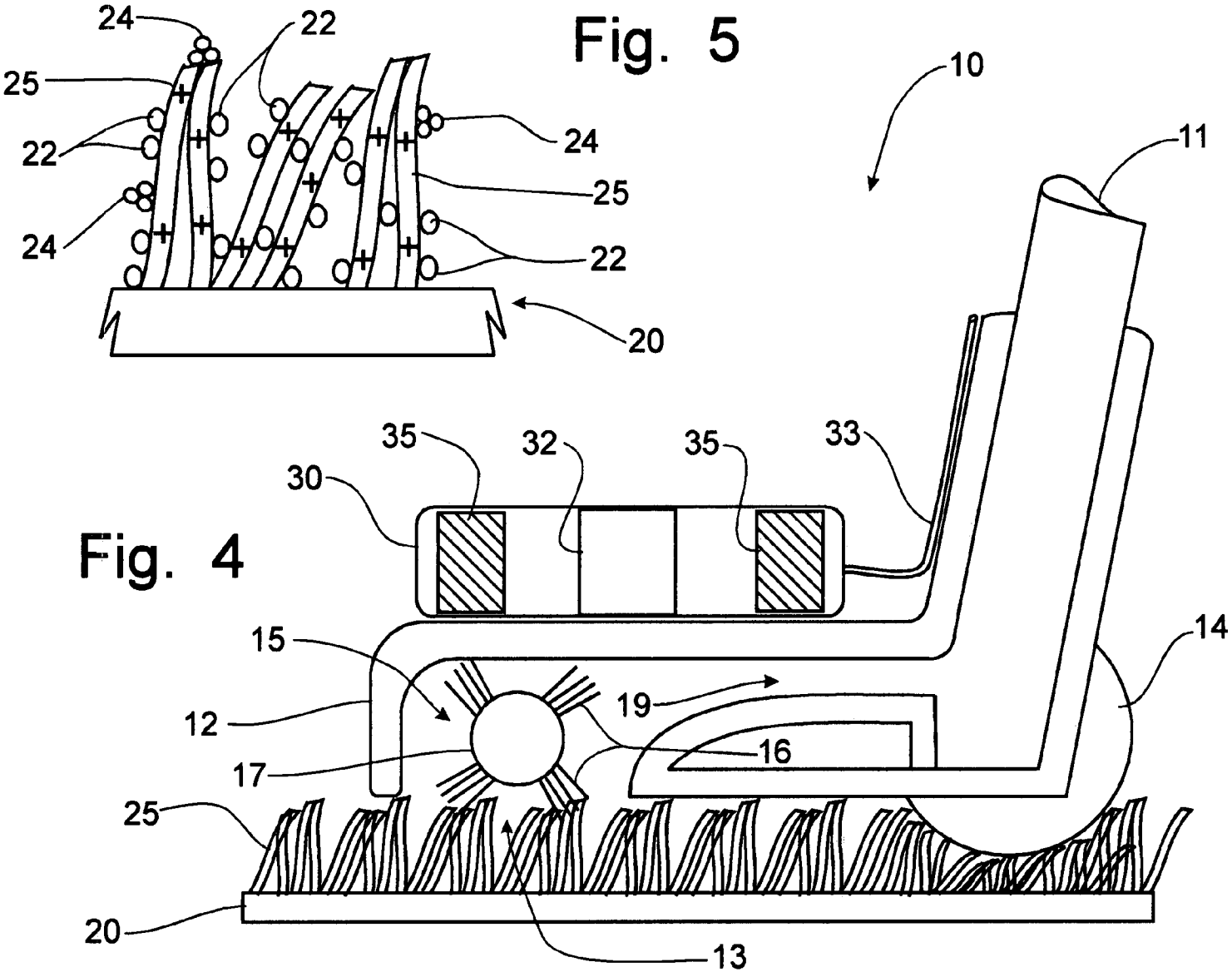
FIG. 4 is a cross-sectional view of the cleaning head shown in FIGS. 2 and 3, taken along lines 4--4 of FIG. 3.
FIG. 5 is an enlarged schematic partial elevational view of a section of carpet prior to being cleaned with the cleaning head incorporating the principles of the instant invention, with small dust particles and bacteria being statically attracted to the oppositely charged carpet fibers.

Unfortunately, the beater brush 15 is not capable of dislodging mechanically the small dust particles from the carpet fibers 25, as the attractive force of the smaller particles to the oppositely charged carpet fibers 25 is exponential in strength as an inverse function of the distance between the attracted particles. In other words, as is represented in FIG. 5, the smaller dust particles 22 and bacteria 24 are more attracted to the carpet fibers 25 because the smaller particles 22, 24 are closer to the carpet fibers 25, as the closer the smaller particles 22, 24 are to the carpet fibers 25, the attractive forces increase exponentially. Thus, dust particles, bacteria, allergens, and mold spores, which are representative of the small particles and typically have a diameter as small as 0.001 micron, have a large attraction to the oppositely charged carpet fibers 25.

As is represented in FIG. 5, the smaller particles 22, 24 typically have a negative charge and are attracted strongly to the positively charged carpet fibers 25. This static attraction is too great to be subject to dislodgement by the mechanical action of the beater brush 15. As a result, in conventional cleaning heads 10, the smaller particles 22, 24 do not become separated from the carpet fibers 25 and remain in the carpet 20 even after the cleaning head 10 has been moved over the surface of the carpet 20 several times.

This static attraction between the oppositely charged small particles and associated carpet fibers 25 is the subject of the vacuum cleaners in the prior art that have an electrostatic discharge that is intended to eliminate or neutralize the static charges between the particles 22, 24 and the carpet fibers 25. The elimination or neutralization of the static charge differential between the small particles 22, 24 and the carpet fibers 25 is not necessary, as will be described in greater detail below. The housing 12 of the cleaning head 10 is provided with a magnetic flux generator 30 preferably supported on the top surface of the housing 12, but at least at a location to direct the magnetic flux field created by the flux generator 30 into the cleaning zone 13, as is described in greater detail below.

The magnetic flux field serves to disrupt the static charge attraction of dust, dirt and other small particles adhering to the carpet fibers 25, thereby allowing this unwanted material to be separated and removed from the carpet fibers 25. The magnetic field is varied in strength and frequency to vary the level and intensity of the flux field in order to more effectively cause separation of the smaller particles 22, 24 and the carpet fibers 25. The magnetic flux field does not neutralize or eliminate the static charges on the smaller particles 22, 24 or on the carpet fibers 25, but serves to disrupt the attraction so that the beater brush 15 and/or the air flow within the cleaning zone 13 will be more effective in removing these smaller particles 22, 24.

Each particle 22, 24 has a magnetic resonance, which is a function of the molecular substance of the material in the particle 22, 24. The magnetic flux field is pulsed at 50 to 60 Hz. by way of the half wave output of a rectifier 32 converting the AC to DC current. The pulsing of the magnetic field varies the frequency of the disruptive forces so that substantially all sized particles will be subjected to its particular magnetic resonance frequency during the operation of the vacuum sweeper over the carpet 20. When the magnetic resonance of any particular individual particle of dust, dirt or other material is reached, the static attraction between the smaller particle 22, 24 and the carpet fiber 25 is disrupted and the particle can be mechanically separated from the carpet fiber 25 while the static attraction is temporarily disrupted. Three to ten volts of electrical power provided to the magnetic flux generator by the power cord 33 should be sufficient to effect the disruption of substantially all of the smaller particles.

In operation, the half wave output of the rectifier 32 in the magnetic flux generator 30 causes a variable offsetting magnetic resonance at the cleaning zone 13 of the cleaning head 10. The magnetic coil 35 of the magnetic flux generator 30 projects a toroidal magnetic field that bathes the cleaning zone 13 with a pulsing magnetic frequency that disrupts the static attraction between most of the smaller particles 22, 24 and the associated carpet fiber 25. The agitation of the beater brush 15 and the vacuum created by the air flow moving upwardly through the passageway 19 in the cleaning head 10 into the wand 11 can then remove the small particles 22, 24 from the carpet 20 for presentation to the filtration system of the vacuum cleaner. After several sweeps of the cleaning head 10, the allergens, small dust particles, bacteria, mold spores, and other particles having a size as small as 0.001 micron will be virtually eliminated from the carpet 20.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. In a vacuum cleaner having a cleaning head operable to engage flooring materials, such as carpet, to remove dirt particles from said flooring materials and to convey said dirt particles in an air stream moving through a passageway within said cleaning head to a remote filtration system that extracts said dirt particles from said air stream before discharging said air stream into the atmosphere, said cleaning head having an agitating device operable within a cleaning zone at a forward end of said passageway to engage said flooring material for mechanically separating said dirt materials from said flooring material, the improvement comprising:

a magnetic flux generator that creates a magnetic field at said cleaning zone extending across the entire transverse width dimension of said cleaning head and extending into said flooring material at said agitating device to disrupt magnetically a static attraction between said dirt particles and said flooring material to facilitate the operation of said agitating device in effecting separation of said dirt particles from said flooring material.

2. The vacuum cleaner of claim 1 wherein said magnetic flux generator creates a pulsating magnetic field at said cleaning zone to provide a variable strength of said magnetic field over a predetermined period of time to provide variable magnetic frequencies in said magnetic field.

3. The vacuum cleaner of claim 2 wherein said magnetic flux generator includes a rectifier that produces a half wave output converting alternating current to direct current.

4. The vacuum cleaner of claim 3 wherein said flooring material is carpet having a plurality of carpet fibers, said agitating device being a rotating beater brush that engages said carpet fibers to separate mechanically dirt particles from said carpet fibers.

5. The vacuum cleaner of claim 4 wherein said magnetic flux generator is mounted on said cleaning head above said rotating beater brush.

6. The vacuum cleaner of claim 4 wherein said pulsating magnetic frequencies disrupt static attraction between small particles and oppositely charged carpet fibers, thus permitting said small particles to be separated from said carpet fibers and removed through said cleaning head.

7. The vacuum cleaner of claim 6 wherein said small particles include allergens, dust particles, bacteria and mold spores having a size as small as 0.001 micron.

8. A cleaning head for a vacuum sweeper to engage carpet material for the separation of dirt particles from carpet fibers and the removal of said dirt particles from said carpet, comprising:

a housing having a lower portion defining a cleaning zone extending across the entire width dimension of said housing and an upper portion including a conduit for the passage of an air stream having said dirt particles entrained therein for removal thereof from said cleaning head;

an agitating device supported in said housing at a forward portion of said conduit for engagement of said carpet fibers to effect a mechanical separation of said dirt particles from said carpet fibers; and a magnetic flux generator supported on said housing to create a magnetic field extending into the carpet fibers within said cleaning zone across said entire transverse width dimension of said housing below said agitating device to disrupt static attraction between said dirt particles and said carpet fibers and enhance the mechanical separation effected by said agitating device, said magnetic field being pulsed to provide a variety of magnetic frequencies in said cleaning zone to disrupt the static attraction between different sized particles and said carpet fibers.

9. The cleaning head of claim 8 wherein said magnetic flux generator creates a pulsating magnetic field at said cleaning zone to provide a variable magnetic frequency in said magnetic field over a predetermined period of time.

10. The cleaning head of claim 9 wherein said pulsating magnetic frequencies disrupt static attraction between small particles and oppositely charged carpet fibers, thus permitting said small particles to be separated from said carpet fibers and removed through said cleaning head.

11. The cleaning head of claim 10 wherein said small particles include allergens, dust particles, bacteria and mold spores having a size as small as 0.001 micron.

12. The cleaning head of claim 10 wherein said magnetic flux generator includes a rectifier that produces a half wave output converting alternating current to direct current.

13. The cleaning head of claim 12 wherein said agitating device is a rotating beater brush that engages said carpet fibers to separate mechanically dirt particles from said carpet fibers.

14. The cleaning head of claim 13 wherein said magnetic flux generator is mounted on said cleaning head above said rotating beater brush.

15. A method of cleaning particles from carpet fibers utilizing a vacuum sweeper having a cleaning head including a conduit for passage of an air stream through said cleaning head and an agitating device operable at a forward portion of said conduit to dislodge particles mechanically from said carpet fibers, said cleaning head defining a transverse width dimension, comprising the steps of:

applying a magnetic flux field to said carpet at a cleaning zone extending across said transverse width dimension and beneath said agitating device to disrupt static attraction between said particles and said carpet fibers;

removing said particles from said carpet fibers at said cleaning zone by mechanically agitating said carpet fibers with said agitating device while said static attraction is disrupted; and creating an air flow at said cleaning zone to entrain separated particles for removal from said cleaning zone through said conduit.

16. The method of claim 15 wherein said removing step includes the step of mechanically brushing said carpet fibers.

17. The method of claim 15 wherein said applying step includes the steps of:

pulsing said magnetic field to provide a variety of magnetic frequencies in said cleaning zone to disrupt the static attraction between different sized particles and said carpet fibers.

18. The method of claim 17 wherein said pulsing step includes the step of:

rectifying electrical current applied to generate said magnetic field to a half wave direct current having a frequency in the range of 50 to 60 hertz.

19. The method of claim 18 further comprising the steps of:

providing a vacuum sweeper having a cleaning head defining said cleaning zone and providing a rotating beater brush operable within said cleaning zone, said cleaning head creating an air flow from said cleaning zone; and said removing step including the step of agitating said carpet fibers in said cleaning zone by said rotating beater brush to separate said particles from said carpet fibers.

* * * * *